US007482558B2

(12) United States Patent
Koch

(10) Patent No.: US 7,482,558 B2
(45) Date of Patent: Jan. 27, 2009

(54) THERMOTHERAPY DEVICE

(75) Inventor: Jochim Koch, Ratzeburg (DE)

(73) Assignee: Dräger Medical AG & Co. KG, Lübeck (DE)

( * ) Notice: Subject to any disclaimer, the term of this patent is extended or adjusted under 35 U.S.C. 154(b) by 146 days.

(21) Appl. No.: 11/317,783

(22) Filed: Dec. 23, 2005

(65) Prior Publication Data

US 2006/0191905 A1 Aug. 31, 2006

(30) Foreign Application Priority Data

Jan. 28, 2005 (DE) ..... 10 2005 004 076

(51) Int. Cl.
*H05B 3/16* (2006.01)
*A47B 71/00* (2006.01)

(52) U.S. Cl. ..... 219/543; 219/385; 219/203; 219/526; 219/527; 219/405; 248/218.4; 248/230.1; 454/188; 454/189; 5/93.1; 5/658; 5/600; 5/503.1; 5/603; 600/21; 600/22

(58) Field of Classification Search ..... 219/201, 219/520, 536, 548, 552, 553, 385, 203, 526–7, 219/543, 411, 405; 392/375, 326, 391, 407, 392/408, 419; 600/21–2, 22; 5/93.1, 658, 5/600, 503.1, 603, 414; 248/218.4, 230.1, 248/289.4; 28/202.13, 202.12, 204.22, 205.11, 28/205.12, 204.18; 454/188–9
See application file for complete search history.

(56) References Cited

U.S. PATENT DOCUMENTS

| | | | | |
|---|---|---|---|---|
| 5,498,229 | A * | 3/1996 | Barsky et al. | 600/22 |
| 5,759,149 | A * | 6/1998 | Goldberg et al. | 600/22 |
| 6,213,935 | B1 * | 4/2001 | Mackin et al. | 600/22 |
| 6,231,499 | B1 | 5/2001 | Jones | |
| 6,506,147 | B2 * | 1/2003 | Eustace et al. | 600/22 |
| 6,616,599 | B2 | 9/2003 | Koch | |
| 6,691,343 | B1 | 2/2004 | Goldberg et al. | |
| 6,711,937 | B2 * | 3/2004 | Richards et al. | 73/29.01 |
| 7,108,653 | B2 * | 9/2006 | Mackin | 600/22 |

FOREIGN PATENT DOCUMENTS

| | | |
|---|---|---|
| DE | 10127793 | 1/2003 |
| DE | 69820647 | 11/2004 |

* cited by examiner

*Primary Examiner*—Shawntina Fuqua
(74) *Attorney, Agent, or Firm*—McGlew & Tuttle, P.C.

(57) ABSTRACT

A thermotherapy device is operated as an incubator or as an open care unit. The care unit has a bed for receiving newborns, which can be closed with a hood (3). At least one heat radiation source (4) is provided. The hood (3) is located between the bed and the heat radiation source (4) when the thermotherapy device is closed and the hood is at least partially transparent to the radiation originating from the heat radiation source (4). The device allows only a small temperature drop during the transfer from the open mode of operation into the closed mode of operation and vice versa.

40 Claims, 5 Drawing Sheets

THERMOTHERAPY DEVICE

CROSS REFERENCE TO RELATED APPLICATIONS

This application claims the benefit of priority under 35 U.S.C. § 119 of German Patent Application DE 10 2005 004 076.4 filed Jan. 28, 2005, the entire contents of which are incorporated herein by reference.

FIELD OF THE INVENTION

The present invention pertains to a thermotherapy device, which can be operated as an incubator or as an open care unit. Such devices are also called hybrids.

BACKGROUND OF THE INVENTION

Hybrids usually comprise an incubator provided with a removable hood and with a heat radiation source and combine as a result advantages of two types of devices in themselves: The comfortable climate necessary for a patient can be reliably guaranteed with a closed incubator. A heat radiation source above a care unit makes possible the open operation of that unit, which substantially facilitates access to the patient for care and treatment purposes. The function of hybrids can be easily changed over from one type of device to another, i.e., from a closed incubator to an open care unit or vice versa, with little effort.

Closed incubators usually generate the necessary climate by convective heating and an air humidifier; open care units are usually heated by means of heat radiation sources. An incubator of this type, which has a heat radiation source in a removable hood, is known from U.S. Pat. No. 6,231,499 B1. It follows from this that the heat radiation source is located at a very short distance from the patient when the hood is closed and can come into contact with the atmosphere in the interior of the incubator, which sometimes has an increased oxygen content.

To make it possible to rule out injury to the patient and inflammation in an atmosphere with high oxygen content, the heat radiation source must already have been cooled when the incubator is closed or it can be heated only when the hood of the incubator has already been opened and has a sufficient distance from the patient. Since the infrared radiation sources used in practice frequently have surface temperatures of a few hundred degrees Celsius during the operation, the transition time may have to amount to several minutes when the function of such hybrids is changed over from one type of device to another in order to ensure that the infrared radiation source will have cooled sufficiently during the transition from the open care unit to the closed incubator before it comes into the vicinity of the patient and vice versa, and conversely that the infrared radiation source will already have reached a sufficient distance from the patient before it is heated up during the transition from the closed incubator to the open care unit. The temperature in the incubator may decrease greatly for a certain period of time in both cases. This leads to cooling of the patient in the meantime, especially in case of premature newborns.

SUMMARY OF THE INVENTION

The object of the present invention is to provide a hybrid, in which the patient is cooled as little as possible during the changeover from the closed mode of operation to the open mode of operation.

The present invention is based on the arrangement of a heat radiation source at a spaced location from the bed of a hybrid, which distance makes possible the continuous operation of the heat radiation source, which operation is safe for the patient, at any point in time. The present invention is based, furthermore, on the fact that a lower thermal output is necessary to maintain a preset temperature set point in the vicinity of the bed with the incubator closed than in case of an open care unit.

A hybrid according to the present invention has an open care unit with a bed for receiving a newborn, which can be closed with a hood. With the hybrid closed, the hood is located between the heat radiation source and the bed. The hood is transparent to the radiation originating from the heat radiation source at least partially. It is thus possible to preheat the heat radiation source for a sufficiently long time before the beginning of the opening operation. The heat radiation source may advantageously also be operated continuously without having to accept the drawbacks corresponding to the state of the art.

The hood advantageously has such a design that it has surface areas with different transparencies to the radiation originating from the heat radiation source. Various forms of infrared radiators may be used as heat radiation sources.

The surface area with the highest transparency may also comprise an opening in the hood, which should advantageously be closable. Instead of a mechanical opening, the hood may also contain a window transparent to the heat radiation. For example, covering with a film transparent to IR radiation may be provided for such radiation windows. Such film[s] are available commercially, for example, as films based on polyethylene under the trade name "MYLAR, more generically known as polyethylene terephthalate (PET)."

The heat radiation source is arranged rigidly or movably outside the hood, so that the distance between the heat radiation source and the hood changes when the hybrid is opened. The division of the surface areas with different transparencies to radiation originating from the heat radiation source is performed such that the ratio of the surfaces areas with higher transparency which are exposed to radiation to surface areas with lower transparency which are exposed to radiation changes during the guided opening of the hood changes.

The heat radiation is advantageously reflected on the outer side of the hood to a low extent only. In surface areas with lower transparency to the incident heat radiation, absorption of the heat radiation takes place, which is sufficient for the advantageous heating of the hood in these areas. As a result, condensation can be prevented from occurring on the inner side of the hood, which guarantees unobstructed visibility of the patient and is desirable for hygienic reasons. It was otherwise common practice to design the hood as a double-walled hood or to heat it directly electrically for such a protection against condensation. Heating of the hood according to the present invention thus leads to simplifications in terms of manufacturing technology.

The opening of the hood may be combined with a variation of the output of the heat radiation source. As a result, it is ensured, on the one hand, that the heat radiation source can reach its full output in a short time, because lengthy preheating is eliminated, and, on the other hand, a needless energy consumption is avoided during the closed operation of the hybrid. Circuitry means, which ensure a change in the generated output of the heat radiation source shortly after the opening or closing of the hood, are advantageously contained for this purpose.

The output of the heat radiation source may be advantageously set during the closed operation of the hybrid such that it is precisely sufficient for reaching a desired hood temperature. It is advantageous for this purpose to monitor the hood temperature and/or to integrate temperature sensors at the hood in a control circuit for controlling the radiation output of the heat radiation source. The same or another control circuit can monitor the position of the hood and control the output of the heat radiation source based on the position of the hood. This may be sensed by a switch activated when the hood is in the upper or lower position. The hood movement may also be via a motor with features (position sensor) for indicating if the hood is in the upper open or lower closed position. The hood may also simply be moved manually along a guide track or otherwise moved and fixed in the upper and lower positions.

It is especially advantageous if the radiation type heating is combined with other forms of heating of the hybrid. A desired climate can thus be maintained extensively by means of convective heating and an air humidifier until the hybrid is to be opened.

The additional use of the radiation type heating during closed phases can advantageously reduce the lowering of the temperature directly during the opening of the hybrid, because elevated hood temperatures permit lower air temperatures because radiation losses become smaller.

It is advantageous in case of a combination of different types of heating to monitor the interior space of the hybrid with at least one air temperature sensor and to operate at least one heating component in a controlled manner.

The principle according to the present invention can be embodied in an especially simple manner if the heat radiation source is installed stationarily and means that ensure the guided movement of the hood during the opening of the hood are present. The guided movement ensures reproducible conditions during the opening and closing of the hybrid.

There is a constant distance between the heat radiation source and the bed in this case. The division of the surface areas of the hood with different transparencies to the heat radiation and the course of the guided movement in relation to the position of the heat radiation source determine how the ratio of the surface areas with increased transparency which are exposed to radiation to the surface areas with lower transparency which are exposed to radiation changes during the opening and closing of the hybrid. The percentage of the output generated by the heat radiation source, which arrives at the bed in the form of heat radiation, changes as a result. Combined with a variation of the output of the heat radiation source, it is thus possible to obtain very slight temperature variations during the phases of transition, as a result of which unacceptable cooling of the patients can be prevented from occurring with certainty.

Besides the control of the air temperature, control of the humidity of the air and/or the oxygen content in the air may be carried out as well. As a result, the hybrid forms a highly comfortable incubator in the closed state.

The fresh air supply may be embodied in such a way that continuous supply of fresh air, optionally via a bacteria filter, generates a slight overpressure on the order of magnitude ranging from a fraction of 1 Pascal to a few Pascals in the closed incubator. It can be ensured as a result that no air will enter from the outside through smaller openings or leaks.

A mattress for the patient, which is equipped with a mattress heater in a preferred embodiment, is advantageously located in the hybrid. The mattress may likewise be heated in a controlled manner and the mattress heater may be integrated as a heating component in the overall design of heating the hybrid in both the open state and the closed state.

An exemplary embodiment of the present invention will be explained on the basis of the following drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
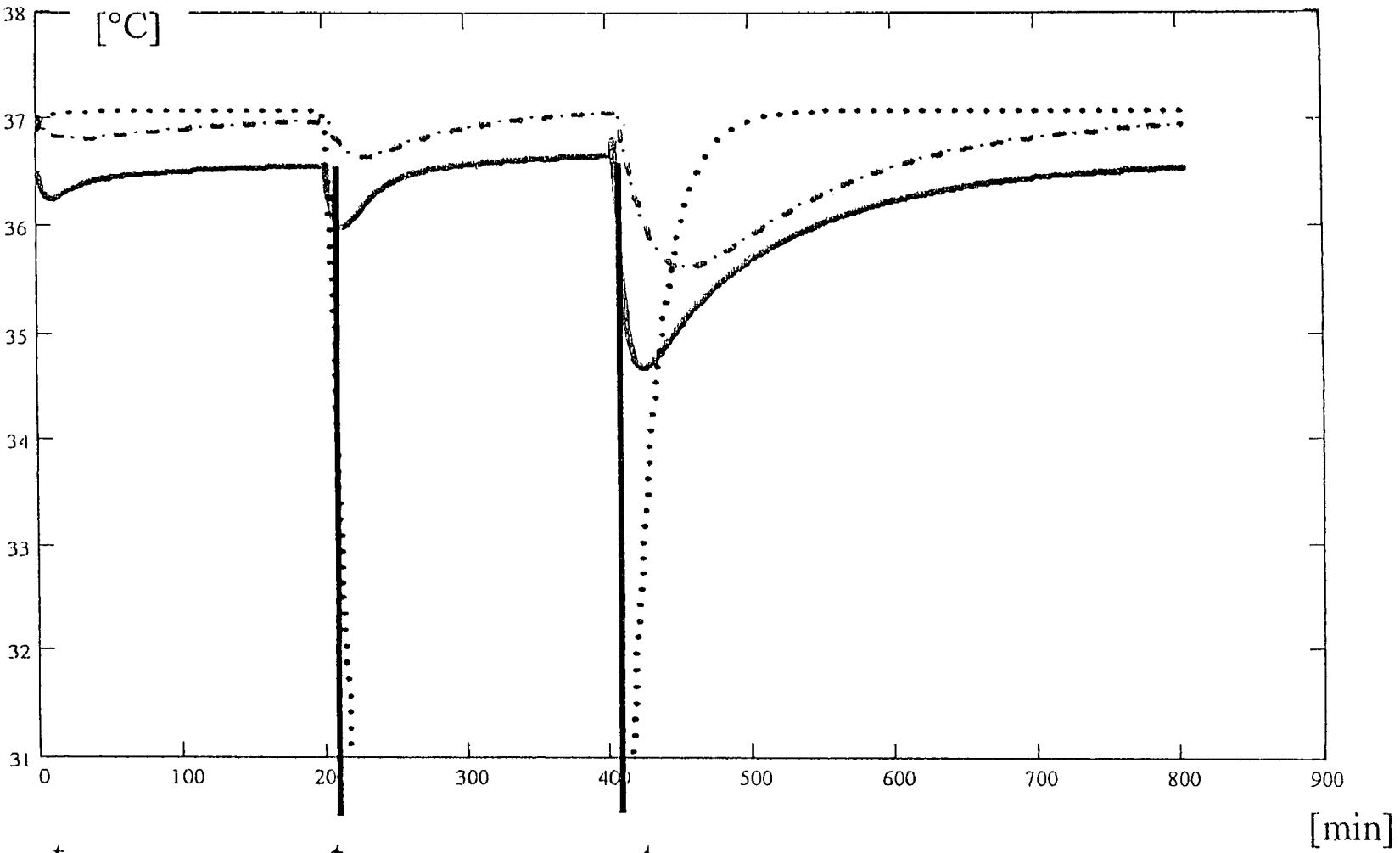
FIG. 1 is a diagram showing the course of the core temperature and the skin temperature over time in case of a premature infant as well as of the air temperature in a hybrid according to the state of the art.

Referring to the drawings in particular, FIG. 1 shows the course of the core temperature over time as a broken line, and the course of the peripheral temperature of a premature infant over time is indicated by a solid line. The exemplary premature infant weighs 500 g, was born during week 26 of pregnancy and is four days old. The air temperature in the incubator for the premature infant in a hybrid according to the state of the art is indicated by a dotted line. The temperatures are always plotted in degrees Celsius (° C.) over the time in minutes (min).

The premature infant is placed into the incubator at time $t_0=0$, the incubator is closed and the convective heater is switched on. The air temperature in the incubator rises rapidly from 35° C. to 37° C., and the peripheral temperature of the premature infant rises from 35° C. to 36° C. with a slight time delay in relation thereto. The core temperature of the premature infant drops during the same period from 36.5° C. at first to 36° C. due to the initially somewhat cooler air temperature in the incubator, but it then rises again gradually to 36.5° C. All temperatures will have stabilized at the time $t_1=200$: The air temperature in the incubator is 37° C., the peripheral temperature of the premature infant is 36° C., and the core temperature is 36.5° C. The convective heater is switched off at the time $t_1=200$, the incubator is opened, and a heat radiation source directed toward the incubator is switched on. The air temperature in the incubator abruptly drops to below 31° C. as a consequence of this, the skin temperature and the core temperature of the premature infant decrease slightly during a short period of time, after which the core temperature rises to a value of about 37° C., and the peripheral temperature likewise rises to nearly 37° C. and reaches a higher value than with the incubator closed and the convective heater switched on. All temperature will again have stabilized at the time $t_2=400$: The temperature in the opened incubator is 31° C., the peripheral temperature of the premature infant is approximately 37° C., and the core temperature is somewhat higher than 37° C. The convective heater is again switched on at time $t_2$=400, the incubator is closed and the heat radiation source directed toward the incubator is switched off. The consequence of this is that the air temperature in the incubator rises again to 37° C. very rapidly, whereas the core temperature drops greatly to 35.5° C. and the peripheral temperature to 34.5° C. All temperatures are again stabilized after a certain time: The air temperature in the closed incubator and the core temperature of the premature infant at about 37° C., and the peripheral temperature of the premature infant at 36°.

In summary, it can be stated that unacceptable variations occur in both the core temperature and the peripheral temperature of the premature infant during the changeover from the closed hybrid with convective heating to the open hybrid with heat radiation source and vice versa in the case of hybrids according to the state of the art.

Figure 2:
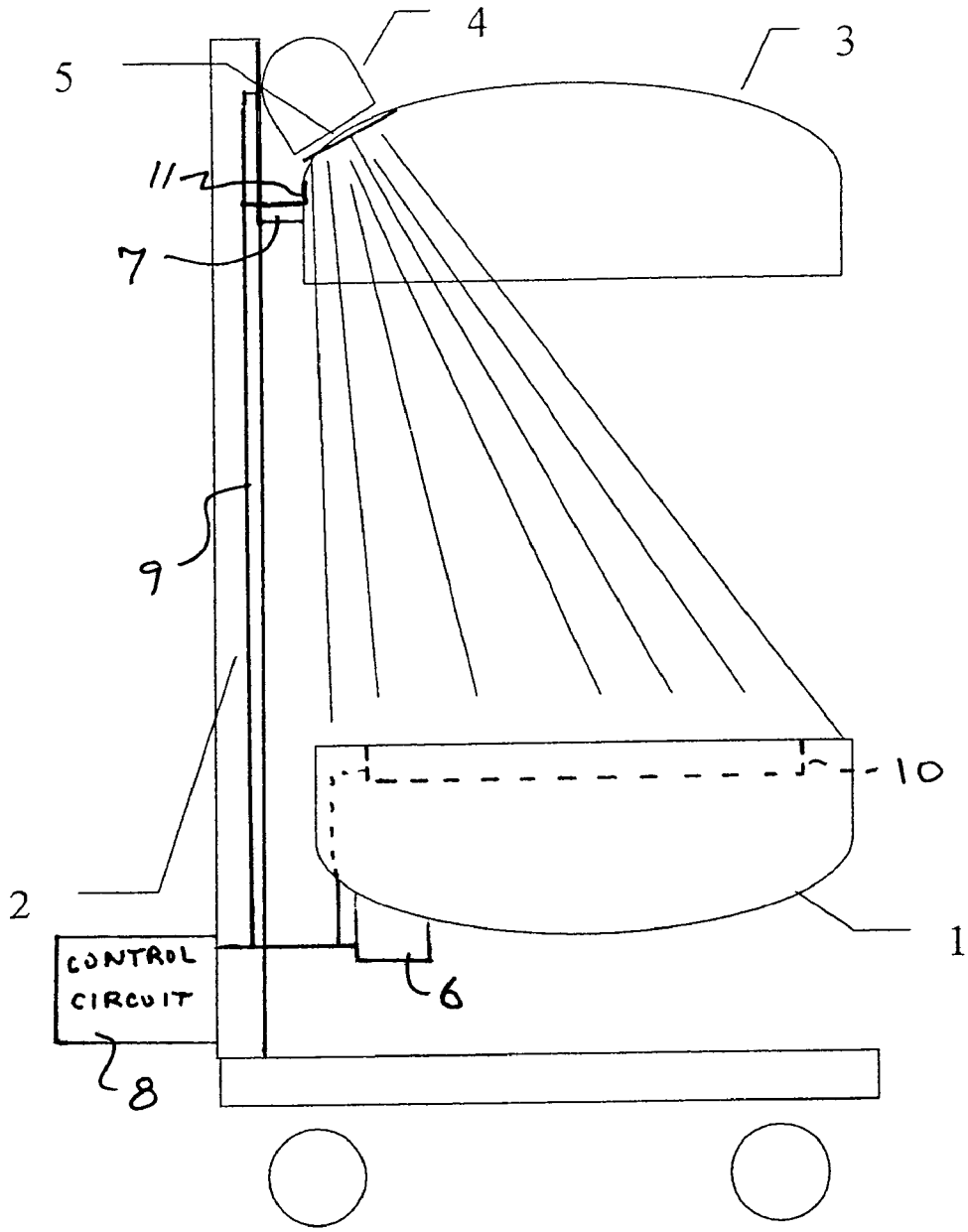
FIG. 2 is a schematic view showing a hybrid according to an embodiment of the present invention in the open mode of operation.

FIG. 2 shows a hybrid according to the present invention in the open mode of operation. An open care unit 1 with a bed for receiving newborns (infants), and a stand arrangement 2, at which a hood 3 can be moved up and down in a guided manner, are present. In the manner shown, the hood 3 is in an upper end position in the open state. An infrared radiation is mounted stationarily as the heat radiation source 4 at the upper end of the stand arrangement 2. The hood 3 has a radiation window in the form of an opening 5 covered with a film transparent to infrared radiation, which is placed such that it is located directly in front of the heat radiation source 4 in the upper end position of the hood 3. As a result, the entire radiation output released can be released in this position through the opening 5 in the direction of the bed nearly without any interaction with the hood 3. The output of the heat radiation source is set such that the newborn will not cool off in the open state of the hood 3.

Figure 3:
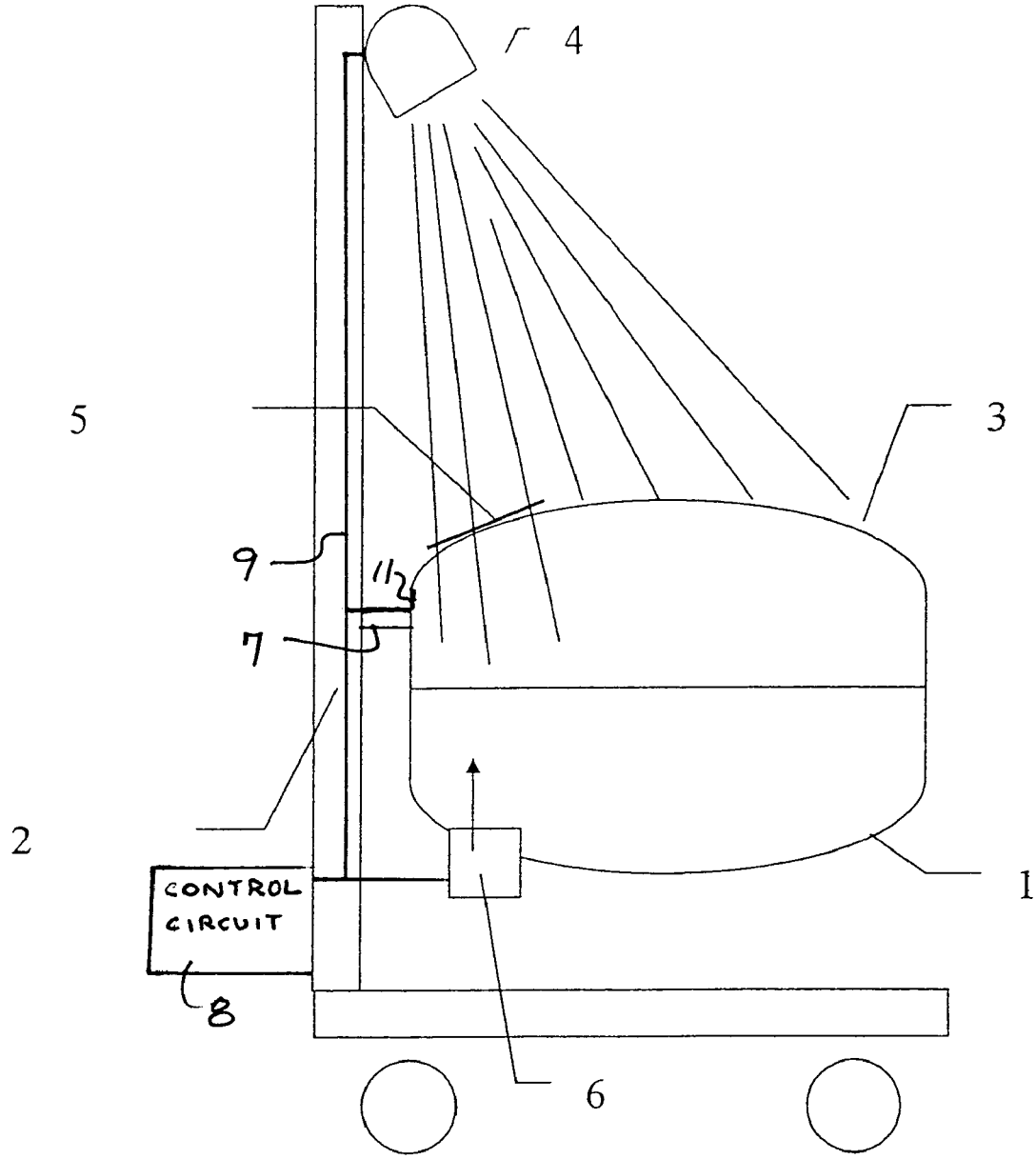
FIG. 3 is a schematic view of the hybrid according to the embodiment of FIG. 2, shown in the closed mode of operation.

FIG. 3 shows an identical hybrid according to the present invention in the closed mode of operation. Due to the greater distance between the hood 3 and the heat radiation source 4, a large part of the radiation output released falls on the outer side of the hood 3. The hood is of a transparent design, but it has a marked absorption in the infrared spectral range. As a result, only part of the radiation output released will reach the bed. The other part contributes predominantly to the heating of the hood 3. The output of the heat radiation source is set such that due to absorption of the radiation emitted by the heat radiation source 4, the hood 3 is heated in its closed state to a temperature at which no condensation takes place on the inner side of the hood 3. The temperature in the closed hybrid is stabilized by means of a controlled convective heater 6.

The opening 5 and the rest of the hood 3 form surface areas with different transparencies to the radiation originating from the heat radiation source 4 in the sense of the present invention. In any case, the heat radiation source 4 is arranged at a distance from the bed, which distance makes possible the safe operation of the heat radiation source 4 at any point in time.

FIGS. 2 and 3 also show the stand arrangement acting as a guide or track connected at 7 to the hood 3. The movement may be via a motor or may be done manually, with the connection 7 have a mechanism for fixing the hood in the upper open (FIG. 2) or lower closed (FIG. 3) position. A control circuit 8 can be used as the radiation output control means to ensure a change in the generated output of the heat radiation source 4 at a short time interval from the opening or closing of said hood 3 (upon sensing the hood 3 in the upper position or the lower position). The control 8 may be connected to the heat radiation source 4 via lines 9 with this also connecting to the controlled convective heater 6 as well as a heated mattress 10. The heat radiation source 4 may be controlled as to output, particularly in the closed state based on the temperature of the hood, detected at a temperature sensor 11.

Figure 4:
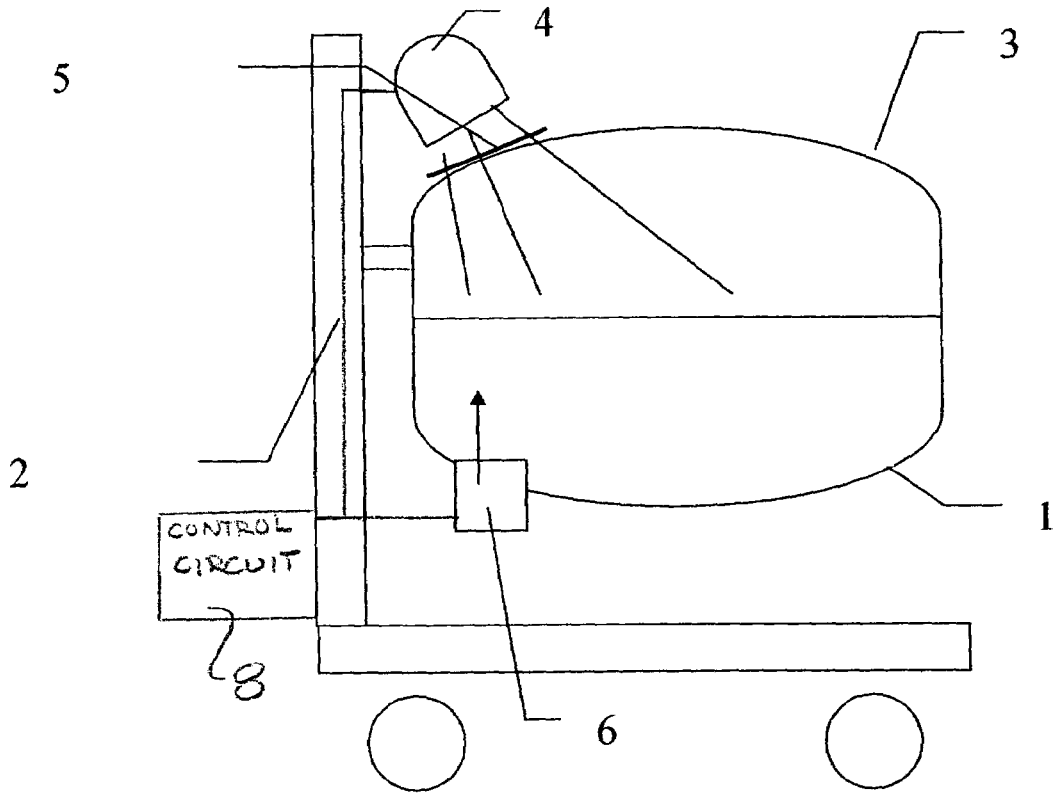
FIG. 4 is a schematic view showing a hybrid according to another embodiment of the present invention in the closed mode of operation.
Figure 5:
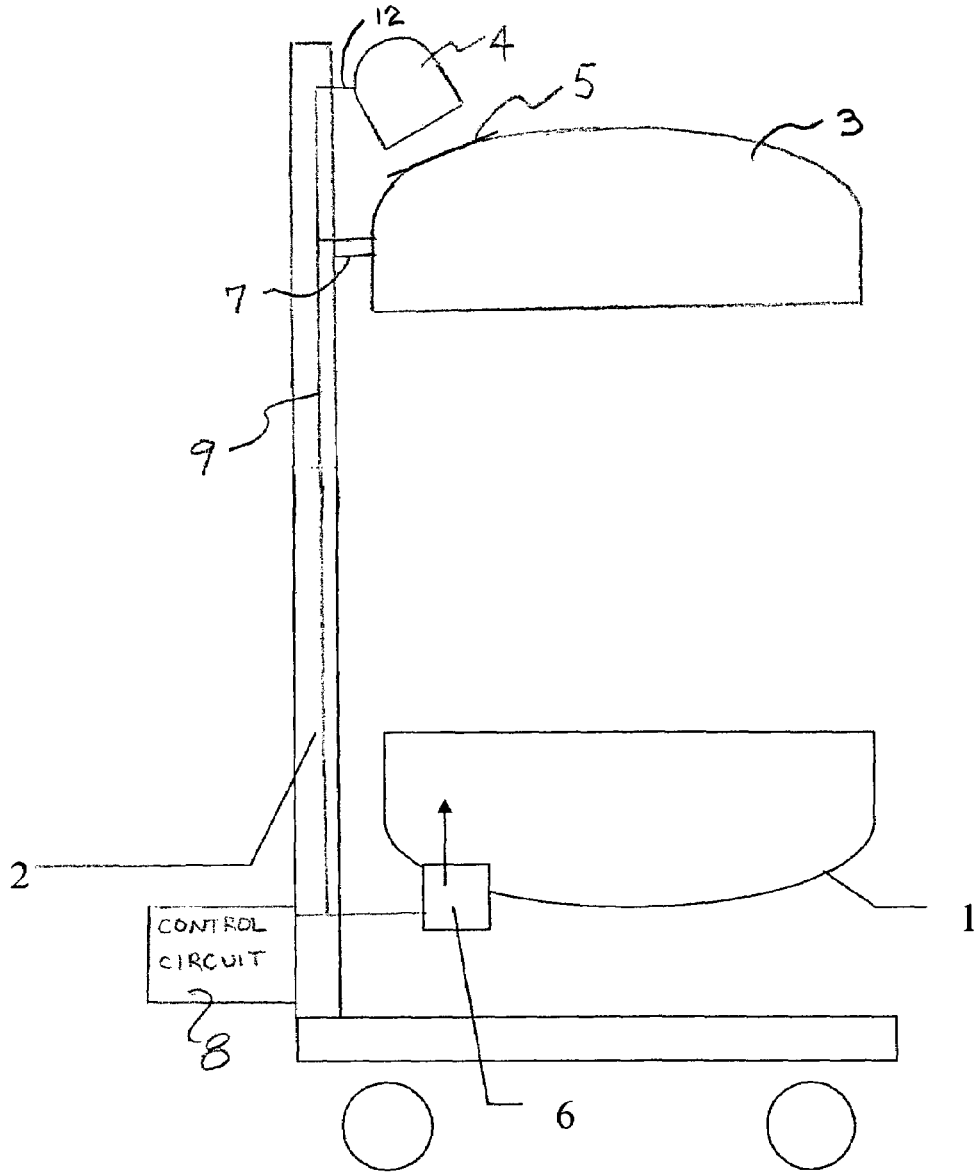
FIG. 5 is a schematic view of a hybrid according to the embodiment of FIG. 4 of the present invention showing the open mode of operation.

FIG. 4 shows an additional embodiment of the invention, where the heat radiation source 4 is at a fixed location relative to the hood 3. The radiation source 4 is movable with the hood 3 as the hood is moved from an closed position shown in FIG. 4 to the open position shown in FIG. 5. The stand arrangement 2 may allow for the change of the hood 3 between the open and closed state by a telescoping arrangement which provides the electrical connection to the control circuit 8. The stand arrangement 2 may also be as in the embodiment of FIG. 1, in which case the hood 3 and radiation source 4 are guided along the stand arrangement 2 as they move between the open and closed positions.

According to the embodiment of FIG. 4 a means is provided for adjusting the heating power (e.g. control circuit 8) of the heat radiation source 4 simultaneously (at a short time interval) with opening the hood 3. At the time of adjusting the heating power, the heating power may be increased for opening and the heating power may be decreased or even discontinued before, after or upon closing the hood 3.

The radiation source in this embodiment may be fully fixed as to spacing and angular orientation relative to the hood 3 based on a connection 12 between radiation source 4 and the stand arrangement 2. However, as an alterative, the connection 12 between radiation source 4 and the stand arrangement 2 may include a pivot fixed in position relative to the hood 3, allowing the radiation source 4 to be pivoted to a different angular orientation. As with the other embodiment, with the embodiment of FIG. 4, surface areas 5 of the hood may be provided with different transparencies to the heat radiation can be present. In the lower position, the radiation source 4 maybe pivoted to be directed toward surface areas for marked absorption in the infrared spectral range. As a result, only part of the radiation output released will reach the bed with other parts contributing predominantly to the heating of the hood. Also, the control may switch off the radiation source 4 in the lower closed position of the hood.

While specific embodiments of the invention have been shown and described in detail to illustrate the application of the principles of the invention, it will be understood that the invention may be embodied otherwise without departing from such principles.

What is claimed is:

1. A thermotherapy device which can be operated as an incubator or as an open care unit, the thermotherapy device comprising:

a care unit with a bed for receiving newborns;

a heat radiation source; and a hood for closing off the care unit, said hood being located between said bed and said heat radiation source when said thermotherapy device is closed, said hood being at least partially transparent to radiation originating from said heat radiation source with said hood having surface areas with different transparencies to the radiation, wherein said surface areas are divided such that the ratio of said surface areas with higher transparency which are exposed to radiation to surface areas with lower transparency which are exposed to radiation changes during a guided opening of said hood.

2. A thermotherapy device in accordance with claim 1, wherein said heat radiation source is arranged at a distance from said bed that makes possible a safe operation of the thermotherapy device for a patient at any point in time.

3. A thermotherapy device in accordance with claim 1, wherein said heat radiation source has a control circuit for permanent irradiation.

4. A thermotherapy device in accordance with claim 1, wherein said heat radiation source has a control circuit for controlling radiation output with a higher output in the opened state of said thermotherapy device than in the closed state.

5. A thermotherapy device in accordance with claim 1, wherein said hood contains a closable opening.

6. A thermotherapy device in accordance with claim 1, wherein said hood contains a radiation window covered with a film.

7. A thermotherapy device in accordance with claim 1, wherein said hood contains a radiation window covered with a PET film.

8. A thermotherapy device in accordance with claim 1, further comprising means that ensure a guided movement of said hood during the opening of said hood.

9. A thermotherapy device in accordance with claim 1, wherein said heat radiation source is arranged such that the distance between said hood and said heat radiation source changes during the opening of said hood.

10. A thermotherapy device in accordance with claim 1, further comprising control means to provide a change in the generated output of said heat radiation source at a short time interval from the opening or closing of said hood.

11. A thermotherapy device in accordance with claim 1, wherein at least parts of said hood possess absorption properties that ensure heating of said hood to a temperature at which no condensation takes place on the inner side of said hood due to absorption of the radiation originating from said heat radiation source in the closed state of said hood.

12. A thermotherapy device in accordance with claim 1, further comprising an additional means for heating said thermotherapy device in addition to said heat radiation source.

13. A thermotherapy device in accordance with claim 12, wherein said additional means for heating comprises a heatable mat.

14. A thermotherapy device in accordance with claim 12, wherein said additional means for heating comprises a convective heater.

15. A thermotherapy device in accordance with claim 13, further comprising control means for the controlled operation of a heating component comprising one of said radiation source and another heater.

16. A thermotherapy device in accordance with claim 15, further comprising a means for measuring a hood temperature.

17. A thermotherapy device in accordance with claim 16, wherein said control means utilizes the hood temperature as a controlled variable in a control circuit.

18. A thermotherapy device in accordance with claim 1, wherein said heat radiation source is installed stationarily.

19. A thermotherapy device in accordance with claim 1, further comprising an overpressure generator for generating an overpressure in the interior of said thermotherapy device when said hood is closed.

20. A thermotherapy device which can be operated as an incubator or as an open care unit, the thermotherapy device comprising:

an open care unit with a bed for receiving newborns;

a heat radiation source;

a hood for closing off the care unit, said hood being located between said bed and said heat radiation source when said hood is closed and said hood being at least partially transparent to the radiation originating from said heat radiation source, said hood having surface areas with different transparencies to the radiation; and radiation output control means changing a generated output of said heat radiation source at a short time interval from the opening or closing of said hood.

21. A thermotherapy device in accordance with claim 20, wherein said heat radiation source is arranged at a distance from said bed that makes possible a safe operation of the thermotherapy device for a patient with said hood in an open position and with said hood in a closed position.

22. A thermotherapy device in accordance with claim 20, wherein said heat radiation source is arranged such that the distance between said hood and said heat radiation source changes during the opening of said hood.

23. A thermotherapy device in accordance with claim 20, wherein at least parts of said hood possess absorption properties that ensure heating of said hood to a temperature at which no condensation takes place on the inner side of said hood due to absorption of the radiation originating from said heat radiation source in the closed state of said hood.

24. A thermotherapy device in accordance with claim 20, further comprising an additional means for heating said thermotherapy device in addition to said heat radiation source.

25. A thermotherapy device in accordance with claim 20, further comprising a temperature sensor for measuring the hood temperature, said control means being connected to said temperature sensor for controlling the generated output of said heat radiation source based on the measured hood temperature when said hood is closed.

26. A thermotherapy device in accordance with claim 20, wherein said heat radiation source is installed stationarily.

27. A thermotherapy device in accordance with claim 20, further comprising an overpressure generator for generating an overpressure in the interior of said thermotherapy device when said hood is closed.

28. A thermotherapy device in accordance with claim 20, wherein said heat radiation source is arranged at a substantially fixed distance from said hood with said heat radiation source being movable with said hood.

29. A thermotherapy device according to claim 28, wherein said surface areas with different transparencies to the radiation include an at least partially transparent surface area region disposed relative to said heat radiation source so that radiation reaches a region of said bed after passing though said surface area region and regions with absorption properties that ensure heating of said hood, said fixed distance of said heat radiation source relative from said hood is defined by a pivot connection for adjustment of said heat radiation source for directing same at selected surface area regions of said hood.

30. A thermotherapy device which can be operated as an incubator or as an open care unit, the thermotherapy device comprising:

an open care unit with a bed for receiving newborns;

a heat radiation source at a fixed location relative to said bed;

a hood for closing off the care unit in a closed position; and a support for supporting said hood at a location in an open position, said hood being located between said bed and said heat radiation source in each of said closed position and said open position, said hood having an at least partially transparent surface area region that is at least partially transparent to radiation of said heat radiation source with said surface area region being disposed relative to said heat radiation source so that radiation reaches a region of said bed after passing though said surface area region.

31. A thermotherapy device according to claim 30, wherein said hood has heatable regions that possess absorption properties that heat said hood due to absorption of the radiation originating from said heat radiation source and said radiation source is positioned so as to be directed at said hood including directed at said heatable regions in the closed state of said hood and directed at said at least partially transparent surface area region in said open state.

32. A thermotherapy device which can be operated as an incubator or as an open care unit, the thermotherapy device comprising:

a bed for receiving newborns;

a heat radiation source directing heat radiation toward said bed;

a hood movably arranged between a closed position on said bed and an open position spaced from said bed, said hood being arranged between said bed and said heat radiation source in both of said open and closed positions, said hood including a transparent portion for passing the radiation originating from said heat radiation source toward said bed, said hood with said transparent portion closing off said bed;

radiation output control means operating said heat radiation source to generate the heat radiation when said hood is in said open and closed position, said radiation output control means operating said heat radiation source to generate less heat radiation when said hood is in said closed position.

33. A device in accordance with claim 32, wherein:

said radiation output control means operates said heat radiation source prior to opening of said hood and after closing of said hood to compensate for cooling occurring during opening and closing of said hood.

34. A device in accordance with claim 32, wherein:

said hood has additional portions formed of a material to absorb the heat radiation from said heat radiation source;

said radiation output control means operates said heat radiation source when said hood is in said closed position to have the additional portions absorb the heat radiation in order to increase the temperature of said hood.

35. A device in accordance with claim 34, wherein:

said radiation output control means increases the temperature of said hood to prevent condensation from forming on said hood.

36. A device in accordance with claim 34, wherein:

another heat source applies heat to said bed when said hood is in said closed position;

said radiation output control means increases the temperature of said hood to reduce the amount of heat needed by said another heat source.

37. A device in accordance with claim 32, wherein:

said hood includes an absorption portion adjacent to said transparent portion, said absorption portion having a higher absorption property for the heat radiation than said transparent portion, said radiation source and said hood being arranged to have more of the heat radiation pass through said transparent portion than said absorption portion in said open position, said hood and said radiation source being arranged to have more of the heat radiation impinge on said absorption portion in said closed position than in said open position.

38. A device in accordance with claim 32, wherein:

said hood and said heat radiation the source are arranged to have more heat radiation pass through said transparent portion in said open position than in said closed position.

39. A device in accordance with claim 37, wherein:

said heat radiation source is mounted on said hood and is movable with said hood into said closed and open position, said hood is pivotably mounted on said hood to radiate said absorption portion of said hood with more of the heat radiation in said closed than in said open position.

40. A thermotherapy device according to claim 30, wherein:

said hood is movably arranged toward and away from said heat radiation source has said hood moves between said open position and said closed position;

a control unit operates said heat radiation source to direct heat radiation through said hood when said hood is both in said close position and in said open position.

* * * * *